US005120241A

United States Patent [19]

Nakata et al.

[11] Patent Number: 5,120,241

[45] Date of Patent: Jun. 9, 1992

[54] MINIATURE ELECTRICAL CONNECTOR

[75] Inventors: Naohisa Nakata; Kazuhisa Nikaido; Hiroshi Yonemura, all of Tokyo, Japan

[73] Assignee: Hirose Electric Co., Ltd., Tokyo, Japan

[21] Appl. No.: 715,387

[22] Filed: Jun. 14, 1991

[30] Foreign Application Priority Data

Sep. 11, 1990 [JP] Japan ..... 2-94787[U]

[51] Int. Cl.[5] ..... H01R 13/00

[52] U.S. Cl. ..... 439/585

[58] Field of Search ..... 439/578-585, 439/744-749

[56] References Cited

U.S. PATENT DOCUMENTS 3,103,548 9/1963 Concelman ..... 439/585

4,269,469 5/1981 Audic ..... 439/585

*Primary Examiner*—Joseph H. McGlynn

*Attorney, Agent, or Firm*—Kanesaka & Takeuchi

[57] ABSTRACT

A miniature electrical contact terminal includes a shield jacket (3) having a contact support section (6), a shield braid crimping section (7), and an outer sheath crimping section (8); an insulator block (4) fitted in the contact support section and having a through hole (10) with an engaging recess (11); and a signal line contact (5) having an engaging hook (14*a*) for engagement with the engaging recess to hold the signal line contact in place with respect to the insulator block.

5 Claims, 5 Drawing Sheets

MINIATURE ELECTRICAL CONNECTOR

BACKGROUND OF THE INVENTION

1. Field of the Invention

The present invention relates to miniature electrical connectors for shielded cables for use in electronic control units or the like.

2. Description of the Prior Art

FIG. 9 shows a conventional electrical connector of this type, wherein a front portion of an outer sheath g of a shielded cable a is removed to separate a shield braid b from a signal line c. The shield braid b and the signal line c are connected to respective contact terminals e and f of a connector proper d.

In the above conventional electrical connector, however, it is necessary to separately connect the shield braid b and the signal line c to the respective contact terminals e and f by insulation displacement, for example, making the streamlining and automation of the wiring operation difficult. In addition, the signal line c is stripped of the shield braid b near the connector proper d so that there is little or no shield effect near the connector proper d. Moreover, there is a demand for a miniature electrical contact having a narrow shield jacket.

SUMMARY OF THE INVENTION

Accordingly, it is an object of the invention to provide a miniature electrical contact terminal having a narrow shield jacket.

According to the invention there is provided a miniature electrical contact terminal which includes a shield jacket having a contact support section, a shield braid crimping section, and an outer sheath crimping section; an insulator block fitted in the contact support section and having a through hole with an engaging recess; and a signal line contact having an engaging hook for engagement with the engaging recess to hold the signal line engagement with the engaging recess to hold the signal line contact in place with respect to the insulator block.

Since it is possible to connect the signal line of a shielded cable to the signal line contact outside the contact support section of the shield jacket, it is not necessary to insert a crimper die in the contact support section, making the miniaturization of the shield jacket possible.

The above and other objects, features, and advantages of the invention will be more apparent from the following description when taken in conjunction with the accompanying drawings.

DESCRIPTION OF THE PREFERRED EMBODIMENT

Figure 10:
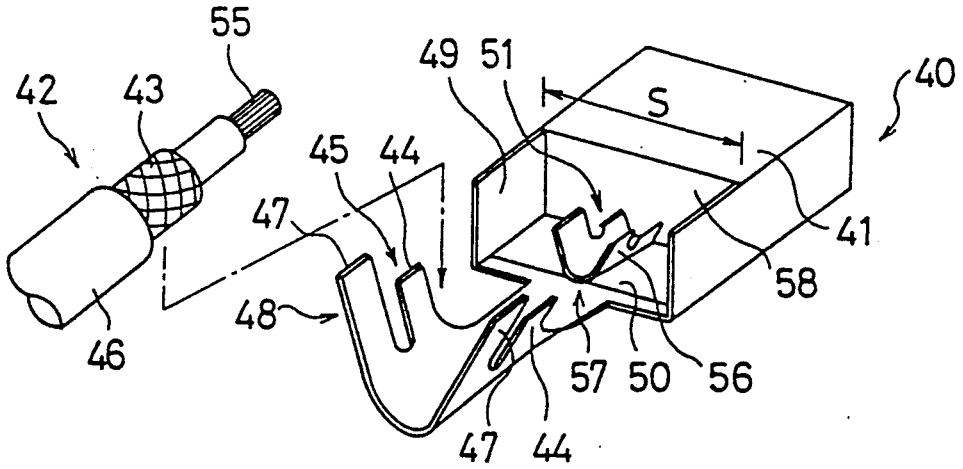
FIG. 10 is a perspective view of an electrical contact terminal according to still another embodiment of the invention.

FIG. 10 shows an electrical connector which is suitable for the streamline and automated wiring operation and has a good shield effect. The electrical connector includes a shield jacket 40 which has a contact support section 41, a shield braid crimping section 45 having a pair of crimping tabs 44 to be crimped to the shield braid 43 of a shielded cable 42, and an outer sheath crimping section 48 having a pair of crimping tabs 47 to be crimped to an outer sheath 46 of the shielded cable 42, and a pair of tool openings 49 and 50 provided on the contact support section 41; a signal line contact 51 with a signal line crimping section 57 having a pair of crimping tabs 56 to be crimped to a signal line 55 of the shielded cable 42; and an insulator block 58 fitted in the contact support section 41 to support the signal line contact 51.

Figure 11:
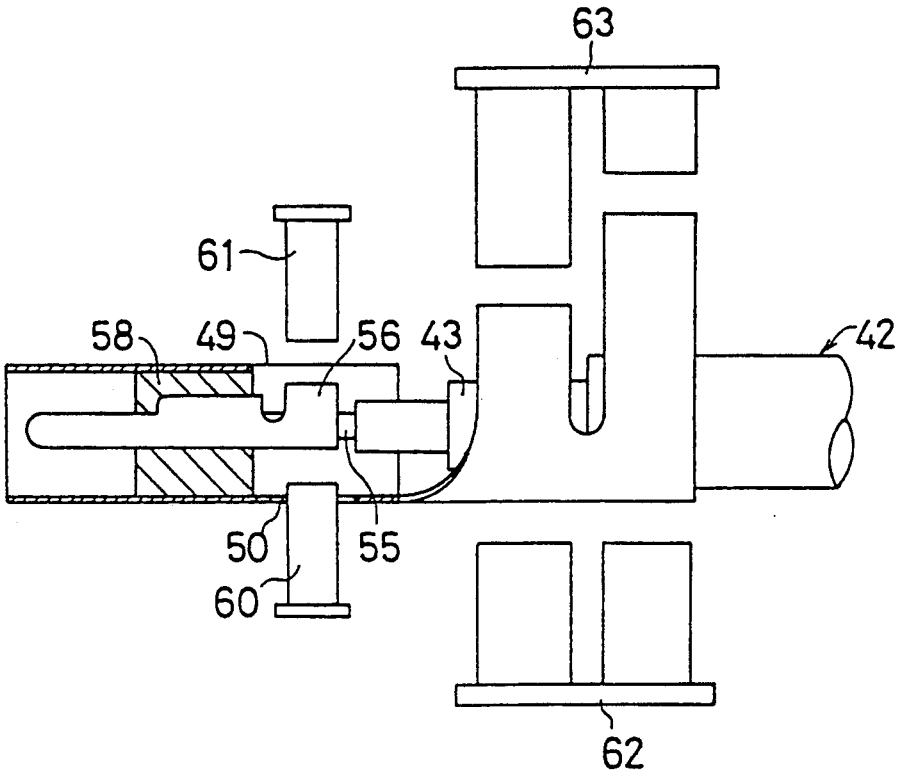
FIG. 11 is a side elevation, partially in section, of the contact terminal to which a shielded cable is being connected.

In FIG. 11, the stripped front portion of the shield cable 42 is placed on the contact terminal 40 such that the signal line 55, the shield braid 43, and the outer sheath 46 rest between the respective crimping tabs 56, 44, and 47. A crimping anvil 60 and a crimper die 61 are then moved toward each other through the tool openings 50 and 49 to crimp the crimping tabs 56 to the signal line 55 while a crimping anvil 62 and a crimper die 63 are moved toward each other to crimp the crimping tabs 44 and 47 to the shield braid 43 and the outer sheath 46 respectively.

Figure 12:
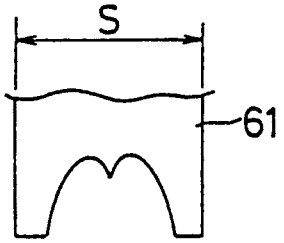
FIG. 12 is a front elevation of a crimper die for crimping the crimping tabs to the signal line.

In the above electrical contact terminal, however, the width of the shield jacket 40 is relatively large because the width S of the crimper die 61 (FIG. 12) is relatively large, and it is impossible to make the width of the tool opening 49 and thus the width of the shield jacket 40 smaller than the width S of the crimper die 61.

Figure 1:
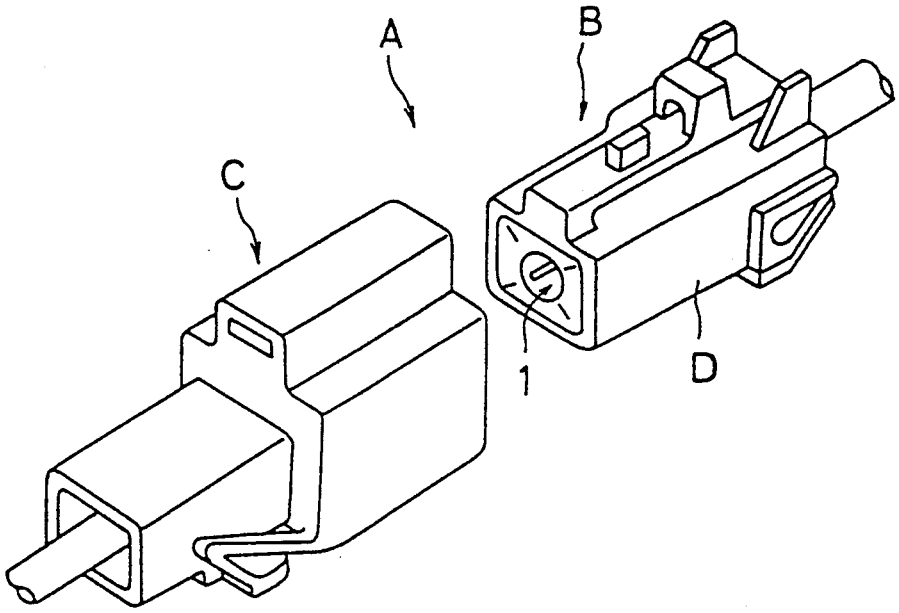
FIG. 1 is a perspective view of a miniature electrical connector according to an embodiment of the invention.
Figure 9:
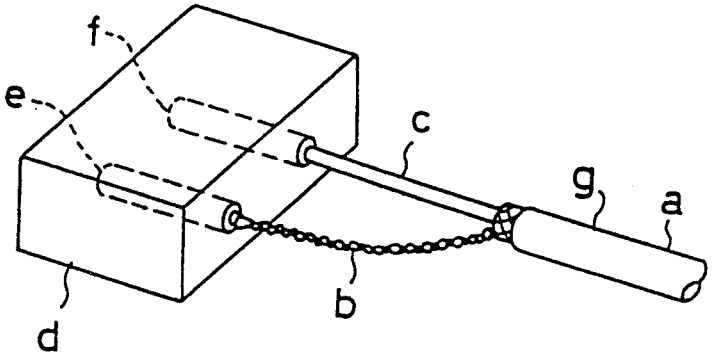
FIG. 9 PRIOR ART
FIG. 9 is a perspective view of a conventional electrical connector.

FIG. 1 shows a miniature electrical connector A consisting of a female connector B and a male connector C. The female connector B has a miniature contact terminal 1 within the housing D.

Figure 2:
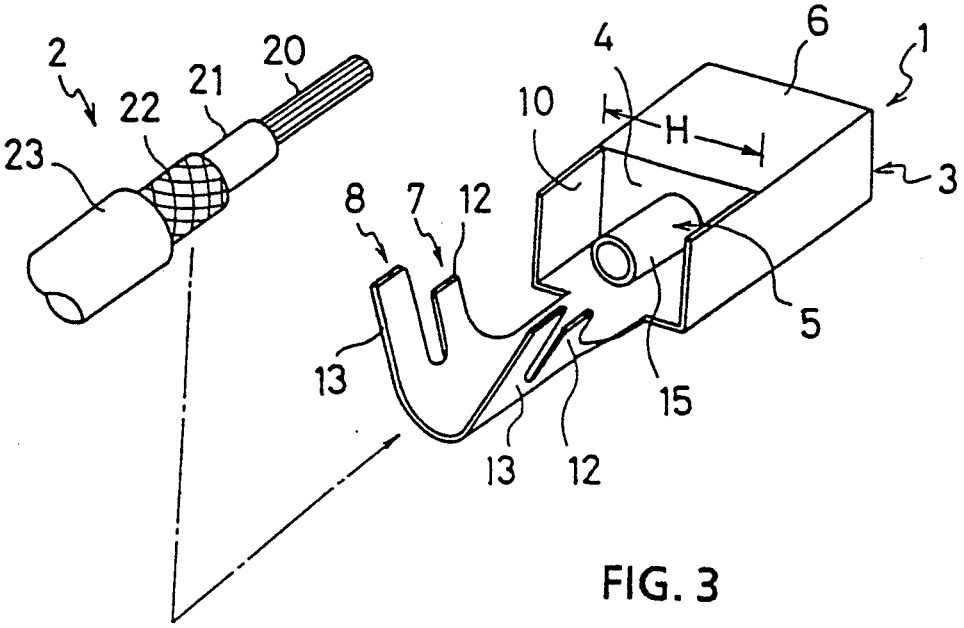
FIG. 2 is a perspective view of a miniature contact terminal according to an embodiment of the invention.

In FIG. 2, the miniature contact terminal 1 consists of a shield jacket 3, an insulator block 4, and a signal contact 5. The shield jacket 3 has a rectangular contact support section 6, a U-shaped shield braid (outer conductor) crimping section 7, and a U-shaped outer sheath crimping section 8. The shield braid crimping section 7 has a pair of crimping tabs 12 while the outer sheath crimping section 8 has a pair of crimping tabs 13 which are made larger than the crimping tabs 12.

Figure 3:
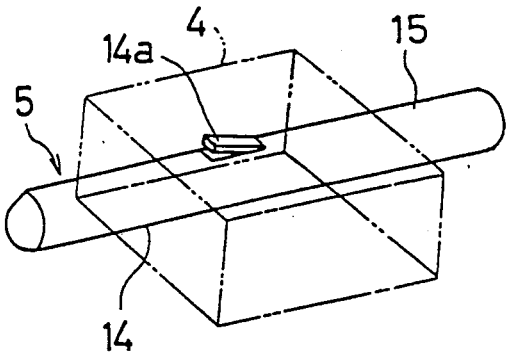
FIG. 3 is a perspective view of a signal line contact useful for the miniature contact terminal.
Figure 4:
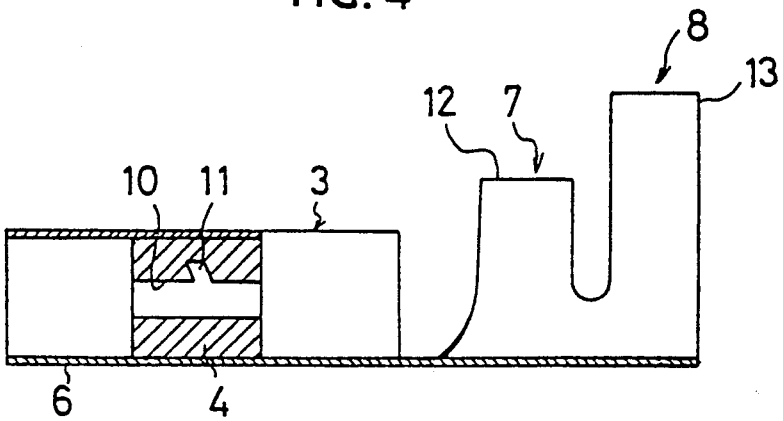
FIG. 4 is a longitudinal section of the contact terminal.

In FIG. 3, the signal line contact 5 has a contact body 14 and a signal line connection portion 15. Both of the contact body 14 and the signal line connection portion 15 are made cylindrical, but the contact body 14 has an engaging hook 14*a* extending forwardly and upwardly from a middle portion thereof. The insulator block 4 is fitted and secured in the contact support section 6 of the shield jacket 3. As FIG. 4 shows, a through hole 10 is formed in the insulator block 4 such that it has an engaging recess 11 extending forwardly and upwardly from a middle portion thereof.

To connect the shielded cable 2 to the miniature contact terminal 1, a front portion of the shielded cable 2 is treated to expose the signal line (central conductor) 20, the intermediate insulator 21, and the shield braid (outer conductor) 22 from the outer sheath 23 as shown in FIG. 2.

Figure 5:
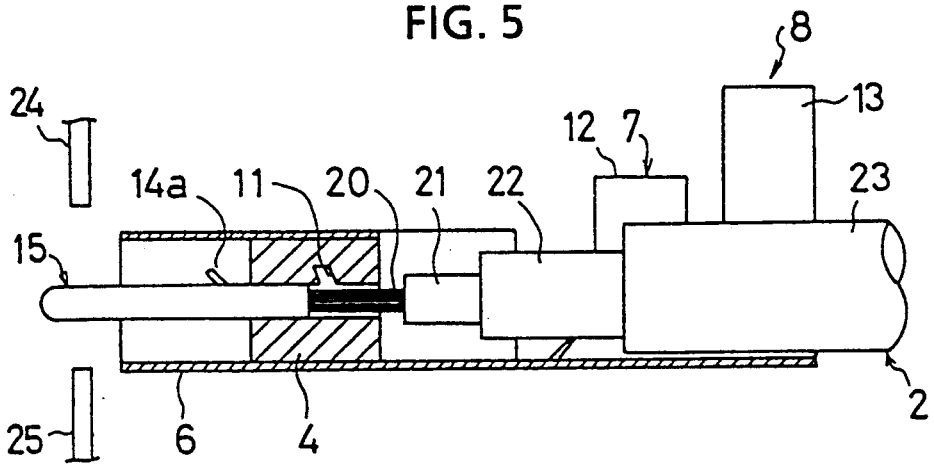
FIG. 5 is a longitudinal section of the contact terminal, wherein a signal line is being inserted into the signal line contact.

As FIG. 5 shows, the signal line 20 is inserted into the signal line connection portion 15 of the signal line contact 5, which is inserted into the insulator block 4 such that a front portion of the signal line contact 5 projects from the front end of the contact support section 6. The projected front portion or signal line connection portion 15 is crimped to the signal line 20 with a pair of crimper dies 24 and 25.

Figure 6:
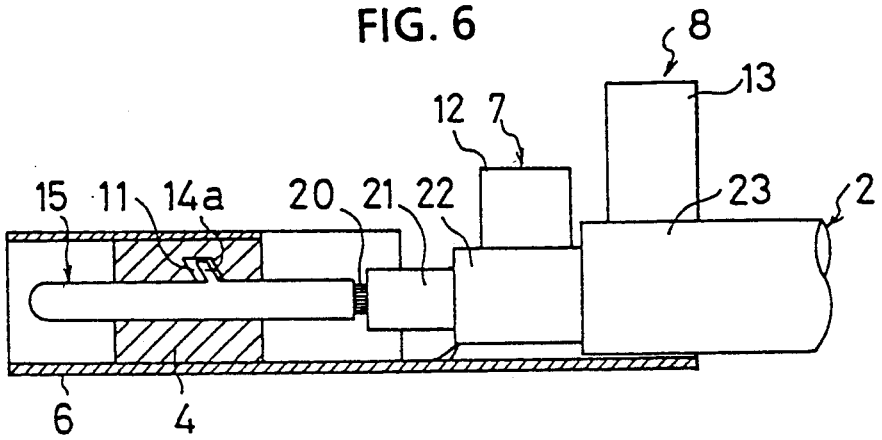
FIG. 6 is a longitudinal section of the contact terminal, wherein the signal line contact has been fitted through the insulation block.

As FIG. 6 shows, the shielded cable 2 is pulled backwardly so that the engaging hook 14*a* engages the engaging recess 11 of the through hole 10 to hold the signal line contact 5 in place while the shield braid 22 and the outer sheath 23 are positioned between the respective crimping tabs 12 and 13.

Figure 7:
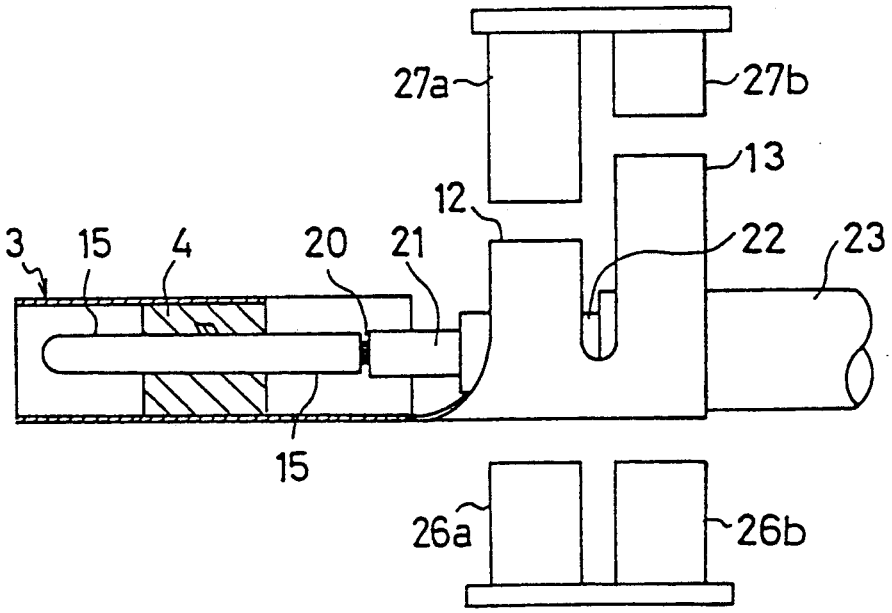
FIG. 7 is a side elevation, partially in section, of the contact terminal to which a shielded cable is being crimped.

In FIG. 7, crimping anvils 26*a* and 26*b* and crimping dies 27*a* and 27*b* are used to crimp the crimping tabs 12 and 13 to the shield braid 22 and the outer sheath 23, respectively, whereby the shielded cable 2 is connected to the miniature contact terminal 1. The miniature contact terminal 1 is then fitted and secured in the housing D to form a female connector B, which is joined to the male connector C for making an electrical circuit.

As has been described above, the signal line 20 is connected to the signal line contact 5 outside the contact support section 6 so that it is not necessary to insert the crimper die in the contact support section 6, making it possible to reduce the width of the contact support section 6 and thus the shield jacket 3.

Figure 8:
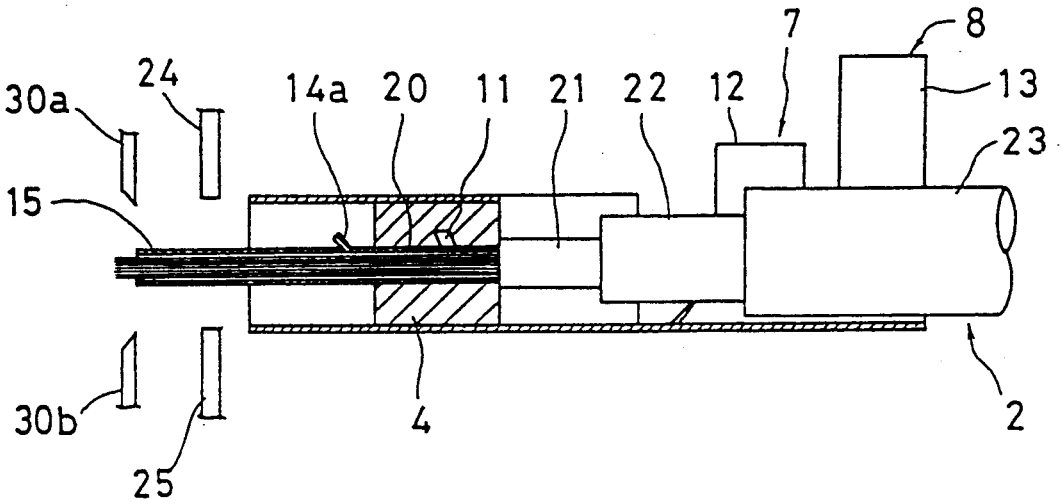
FIG. 8 is a longitudinal section of a contact terminal having an open end signal line contact through which a signal line is inserted according to another embodiment of the invention.

FIG. 8 shows a signal line contact 5 with an open front end according to another embodiment of the invention. The signal line 20 is inserted through the signal line contact 5 so that the front portion of the signal line 20 projects from the front end of the signal line contact 5. The signal line contact 5 is inserted into the through hole 10 of the insulator block 4 such that the front portion of the signal line contact 5 projects from the front end of contact support section 6. The projected portion is crimped with a pair of punch dies 24 and 25 while the excessive signal line 20 is cut off with a pair of cutter blades 30*a* and 30*b*, whereby the signal line 20 is connected to the signal line connecting portion 15 of the signal line contact 5.

We claim:

1. A miniature electrical contact terminal comprising:

a shield jacket having a contact support section, a shield braid crimping section, and an outer sheath crimping section having a pair of tabs;

an insulator block fitted in said contact support section and having a through hole with an engaging recess; and a signal line contact having an engaging hook for engagement with said engaging recess to hold said signal line contact in place with respect to said insulator block;

said signal line contact having a front portion into which a signal line of said shielded cable is inserted and secured;

said signal line contact having a rear portion which has a diameter substantially equal to that of said through hole in said insulator block so that after said signal line is secured to said front portion, it is pulled backwardly until said engaging hook engages said engaging recess.

2. The miniature contact terminal of claim 1, wherein said signal line contact has a closed front end.

3. A method of connecting a shielded cable to said miniature contact terminal of claim 2, which comprises the steps of:

inserting said signal line contact into said through hole such that a front portion of said signal line contact projects from a front end of said contact support section;

inserting a signal line of said shielded cable into said front portion of said signal line contact;

crimping said front portion of said signal line contact to said signal line to secure signal line contact to said signal line;

pulling backwardly said shielded cable so that said engaging hook engages said engaging recess of said through hole to hold said signal line contact in place with respect to said insulator block; and crimping said shield braid crimping section and said outer sheath crimping section to a shield braid and an outer sheath of said shielded cable, respectively, whereby said shielded cable is connected to said miniature contact terminal.

4. The miniature contact terminal of claim 1, wherein said signal line contact has an open front end.

5. A method of connecting a shielded cable to said miniature contact terminal of claim 4, which comprises the steps of:

inserting a signal line of said shielded cable through said signal line contact so that a front portion of said signal line projects from a front end of said signal line contact;

crimping a front end of said signal line contact to said signal line to secure signal line contact to said signal line;

pulling backwardly said shielded cable so that said engaging hook engages said engaging recess of said through hole to hold said signal line contact in place with respect to said insulator block; and crimping said shield braid crimping section and said outer sheath crimping section to a shield braid and an outer sheath of said shielded cable, respectively, whereby said shielded cable is connected to said miniature contact terminal.

* * * * *